US007284490B1

(12) United States Patent
Mutascio

(10) Patent No.: US 7,284,490 B1
(45) Date of Patent: Oct. 23, 2007

(54) ROD WARHEAD SYSTEMS AND ASSOCIATED METHODS

(75) Inventor: Enrico R. Mutascio, Palm Springs, CA (US)

(73) Assignee: Armtec Defense Products Co., Coachella, CA (US)

( * ) Notice: Subject to any disclaimer, the term of this patent is extended or adjusted under 35 U.S.C. 154(b) by 320 days.

(21) Appl. No.: 10/857,704

(22) Filed: May 28, 2004

(51) Int. Cl.
*F42B 12/30* (2006.01)
*F42B 12/66* (2006.01)

(52) U.S. Cl. ..... 102/474; 89/1.11

(58) Field of Classification Search ..... 102/474, 102/473, 504, 489; 89/1.11, 1.1
See application file for complete search history.

(56) References Cited

U.S. PATENT DOCUMENTS

| | | | | | |
|---|---|---|---|---|---|
| 2,322,624 | A | * | 6/1943 | Forbes | 102/504 |
| 3,160,099 | A | * | 12/1964 | Nooker | 102/474 |
| 3,224,371 | A | * | 12/1965 | Kempton et al. | 102/474 |
| 3,224,372 | A | * | 12/1965 | Nooker | 102/474 |
| 3,249,050 | A | * | 5/1966 | Cordle et al. | 102/474 |
| 3,320,888 | A | * | 5/1967 | Churchill | 102/474 |
| 3,434,422 | A | * | 3/1969 | Andreassen et al. | 102/474 |
| 3,490,374 | A | * | 1/1970 | Nooker | 102/474 |
| 3,690,257 | A | | 9/1972 | Nooker et al. | |
| 3,696,750 | A | | 10/1972 | Colgate et al. | |
| 3,696,751 | A | | 10/1972 | Kempton | |
| 3,713,390 | A | | 1/1973 | Pieper | |
| 3,720,168 | A | * | 3/1973 | Sylwester | 102/492 |
| 3,742,856 | A | | 7/1973 | Welanetz | |
| 3,938,441 | A | | 2/1976 | Sewell et al. | |
| 4,077,326 | A | | 3/1978 | Funk et al. | |
| 4,459,915 | A | * | 7/1984 | Lynch | 102/374 |
| H1367 | H | * | 11/1994 | Allen et al. | 102/493 |
| 5,524,546 | A | * | 6/1996 | Rozner et al. | 102/303 |
| H2039 | H | * | 8/2002 | Holt et al. | 102/307 |

* cited by examiner

*Primary Examiner*—James S. Bergin
(74) *Attorney, Agent, or Firm*—Perkins Coie LLP

(57) ABSTRACT

Rod warhead systems and associated methods are disclosed. In one embodiment, a projectile having an arrangement of rods is propelled along a trajectory toward an object. The arrangement of rods is radially expanded from a first position to a second position prior to the projectile impacting the object. The arrangement of rods impacts the object to breach at least a portion of the object. In a further embodiment, the arrangement of rods is expanded from the first position to the second position using a nonexplosive means. In another embodiment, the projectile includes a follow-up explosive device that applies an explosive force proximate to the object after the arrangement of rods impacts the object.

13 Claims, 11 Drawing Sheets

ROD WARHEAD SYSTEMS AND ASSOCIATED METHODS

TECHNICAL FIELD

The following disclosure relates generally to rod warhead systems and associated methods, for example, breaching an object with a rod warhead system.

BACKGROUND

Breaching walls, including reinforced concrete walls, are often required during military operations to allow soldiers and equipment to pass through a breach in the wall. Current technology includes the use of closely-spaced multiple shots of 105 mm M393A2 High Explosive Plastic rounds fired from a Mobile Gun System to create a sufficiently sized breach. This is a difficult procedure under ideal conditions, much less while under fire.

A problem with conventional wall-breaching systems is that the concrete is often removed only to leave a re-bar skeleton in the breach. The re-bar must then be cut and removed to permit passage of troops. Some breaching devices have a re-bar removal feature. For example, an Explosively Formed Projectile that forms a ring-shaped projectile (donut) can be used to cut the re-bar; however, this device is limited to cutting approximately 12-inch diameter holes, which are insufficient in size to permit the passage of troops and large equipment.

Continuous Rod Warheads (CRWs) were originally designed for anti-aircraft operations. The design involved a warhead that, after being fired, radially projected an expanding bundle of zigzag connected rods at a relatively high velocity (e.g., 5,000 feet per second). The expanding bundle of rods would then impact the aircraft cutting and slashing through the aircraft structure. The MK82 Mod 0 warhead of the U.S. Navy AIM-54A Phoenix missile uses CRW technology. Additionally, the military has contemplated using CRW technology to clear terrain of foliage and structures (e.g., to clear a helicopter landing zone) by radially projecting a bundle of rods parallel to the ground, as described in U.S. Pat. No. 3,938,441.

CRW technology involves placing two concentric layers of rods around a cylindrical explosive charge. The alternating ends of the rods are connected together (e.g., by pinning or welding). When the explosive charge detonates, the rod layers are accelerated radially outward at a high velocity. The connections on alternating ends of the rods cause them to form a continuous "zigzag" pattern as they travel outward in an expanding circle or loop. As the rods continue to expand, a point is reached where the rods can no longer remain connected, and the zigzag circle breaks into sections. One problem with this technology is that the explosive charge does not expand the rods consistently in a smooth and even manner. Another problem with this technology is that the warhead requires a dedicated explosive charge for expanding the rods. This, in turn, can require special and/or additional handling and safety procedures.

SUMMARY

The present disclosure is directed toward rod warhead systems and associated methods. One aspect of the invention is directed toward a breaching method that includes propelling a projectile along a trajectory toward a ground-supported structure. The projectile carries an arrangement of rods, expandable from a first position to a second position forming a loop-type formation. The method further includes expanding the arrangement of rods from the first position, radially outward and at least approximately perpendicular to the trajectory of the projectile, to the second position prior to the projectile impacting the ground-supported structure. The method further includes impacting at least a portion of the arrangement of rods in the second position against an impact area of the ground-supported structure and breaching at least a portion of the impact area of the structure with the at least a portion of the arrangement of rods in the second position.

Another aspect of the invention is directed toward a method of expanding the arrangement of rods of a rod warhead system, including propelling a projectile along a trajectory toward an object. The projectile carries an arrangement of rods expandable from a first position to a second position forming a loop-type formation. The method further includes expanding the arrangement of rods from the first position to the second position prior to the projectile impacting the object using at least one force created by at least one of a release of a stored fluid, a spring device, a centrifugal force, and a portion of an expanding fluid used to propel the projectile along the trajectory.

Yet another aspect of the invention is directed toward a rod warhead system that includes a projectile configured to be propelled toward an object on a trajectory. The projectile has a first portion and a second portion. The system further includes an arrangement of rods movable from a first position to a second position. The arrangement of rods is carried in the first position in the first portion of the projectile. The arrangement of rods is configured to move to the second position in a loop-type formation at least approximately perpendicular to the trajectory of the projectile prior to the projectile impacting the object. The system further includes a follow-up explosive device carried in the second portion of the projectile. The follow-up explosive device is configured to exert an explosive force proximate to the object after the arrangement of rods impacts the object.

DETAILED DESCRIPTION

The present disclosure is directed toward rod warhead systems and associated methods, for example, rod warhead systems used to breach an object. Several specific embodiments are set forth in the following description and in FIGS. 1A-10B to provide a thorough understanding of certain embodiments of the invention. One skilled in the art, however, will understand that the present invention may have additional embodiments, and that other embodiments of the invention may be practiced without several of the specific features explained in the following description.

Figure 1A:
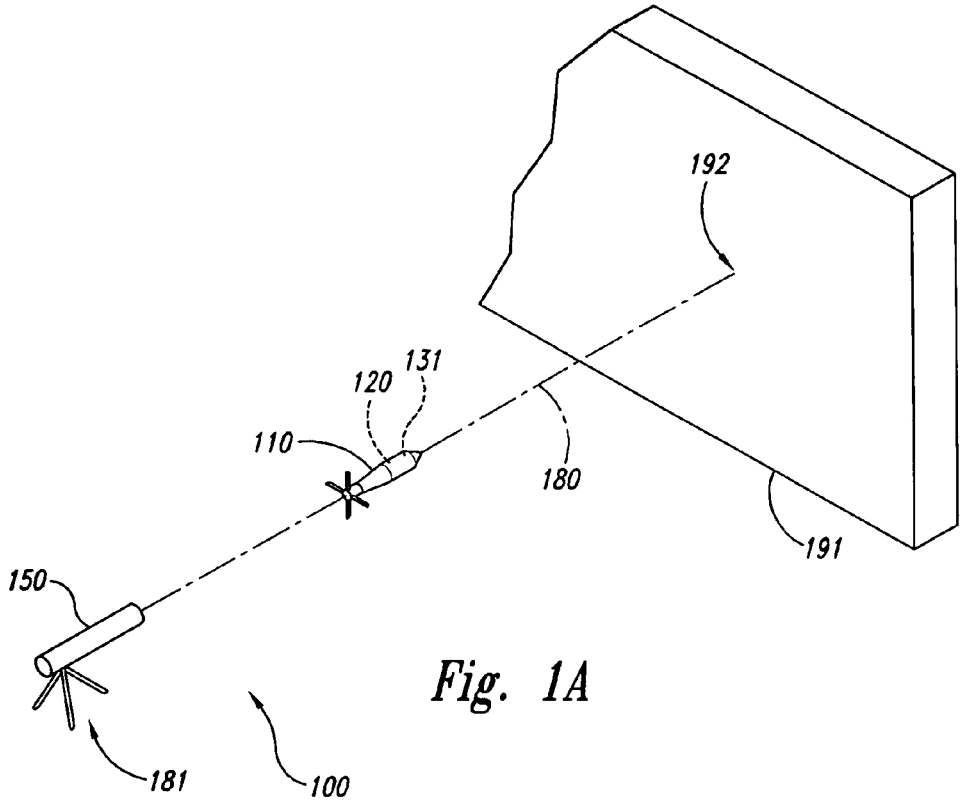
FIG. 1A is a partially schematic illustration of a rod warhead system used to breach a ground-supported structure in accordance with one embodiment of the invention.
Figure 1B:
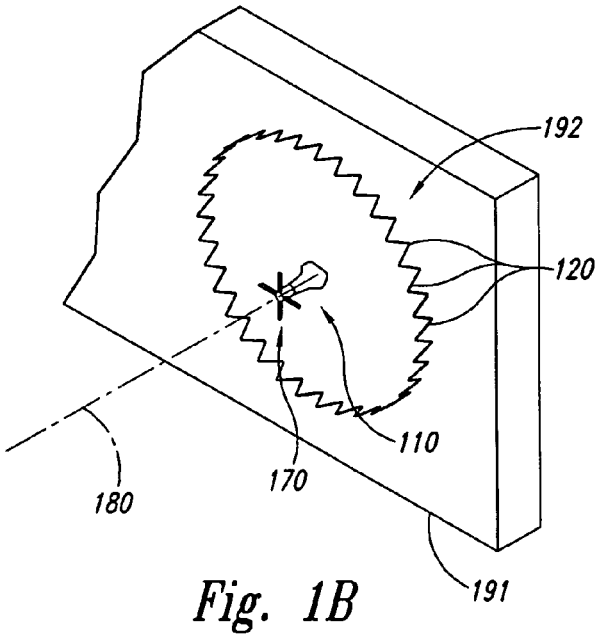
FIG. 1B is an enlarged, partially schematic illustration of the rod warhead system shown in FIG. 1A prior to breaching the ground-supported structure.
Figure 1C:
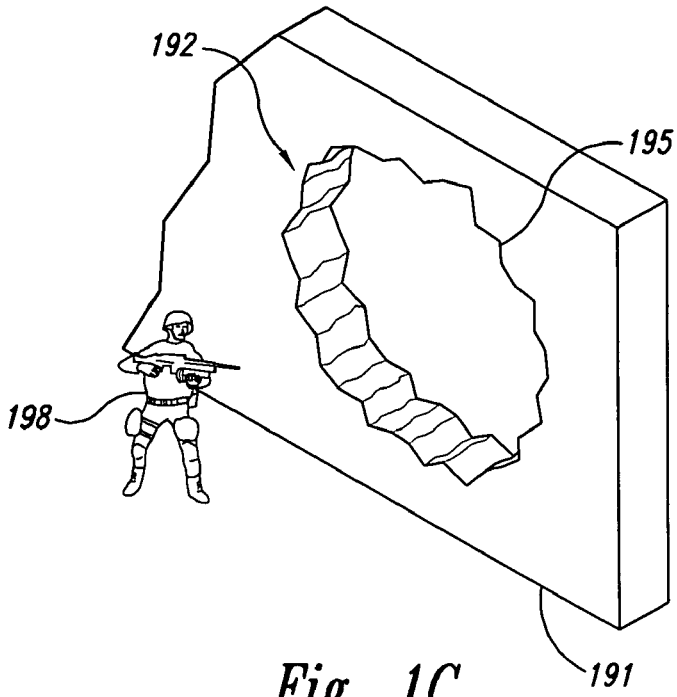
FIG. 1C is a partially schematic illustration of a ground-supported structure that has been breached by the rod warhead system shown in FIG. 1A.

FIGS. 1A-C illustrate a rod warhead system 100 used to breach a ground-supported structure 191 in accordance with an embodiment of the invention. Referring first to FIG. 1A, a launcher 150 located at a selected position 181 launches a warhead projectile 110 on a trajectory 180 toward an impact area 192 of the ground-supported structure 191 (e.g., a wall, building, ground vehicle, or water vessel). The launcher 150 can be a ground-based launcher, a hand-held launcher, an air-based launcher or other mobile launcher. The warhead projectile 110 carries an arrangement of rods 120 and an explosive charge 131 for expanding the arrangement of rods 120. The arrangement of rods 120 in the warhead projectile 110 are carried in a first position before and during launch of the warhead projectile 110. After the warhead projectile is launched, the explosive charge 131 can be detonated at a selected position relative to the ground-supported structure so the arrangement of rods is radially expandable from the first position to a second position.

As shown in FIG. 1B, after the explosive charge is detonated at a selected position 170, the arrangement of rods 120 expands radially to define a loop-type formation in a plane generally perpendicular to the trajectory 180 of the projectile 110. Accordingly, the arrangement of rods 120 radially expands about a central axis generally coterminous with the trajectory 180. The explosive charge can be detonated at the selected position 170, which is determined in part based on the speed of the projectile 110 relative to the ground-supported structure 191 and the expansion rate of the arrangement of rods 120, so the arrangement of rods 120 will have expanded to the second position just before impacting the impact area 192. Accordingly, the expanded arrangement of rods 120 in the loop-type formation cuts through the ground-supported structure 191 at least in a direction generally parallel to the trajectory 180.

FIG. 1C is a partially schematic illustration of the ground-supported structure 191 after the arrangement of rods, shown in FIG. 1B, has impacted and breached a portion of the impact area 192. The loop-type formation of rods has penetrated and/or cut through the at least a portion of the impact area 192. Additionally, the impact of the arrangement of rods against the ground-based structure 191 removes or destroys a portion of structure at the impact area 192, thereby creating an enlarged aperture 195 in the structure 191. The aperture 195 is typically slightly larger than the size of the arrangement of rods in the second position, shown in FIG. 1B, as the arrangement of rods blasts through the structure 191. In the illustrated embodiment, the aperture 195 is large enough for a person 198 and equipment to pass through. In other embodiments, a larger or smaller aperture can be created by using another arrangement of rods (e.g., a larger or smaller number of rods and/or a larger or smaller loop-type formation). In certain embodiments, a tail cone of the projectile can also impact the structure's impact area 192 after the arrangement of rods to aid in the removal of material from the impact area.

Figure 2A:
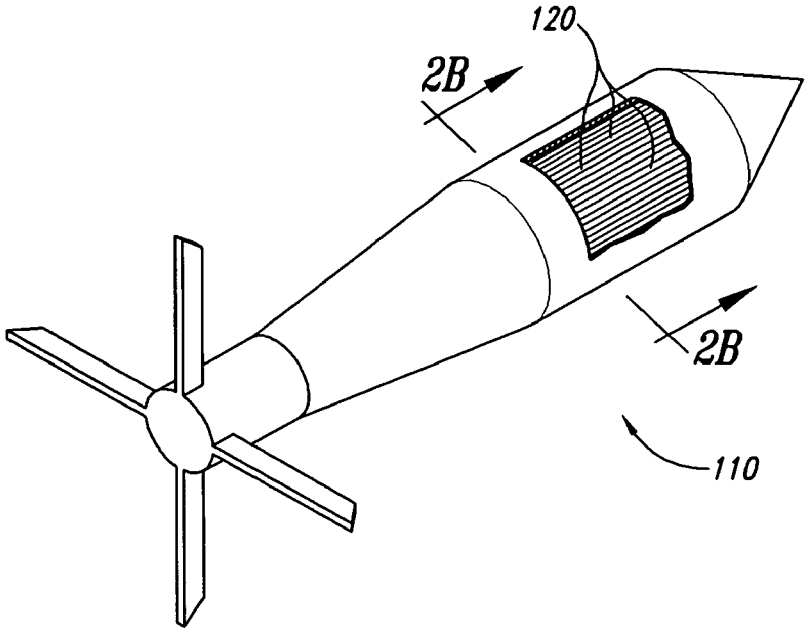
FIG. 2A is an isometric view of the projectile, shown in FIG. 1A, carrying an arrangement of rods.
Figure 2B:
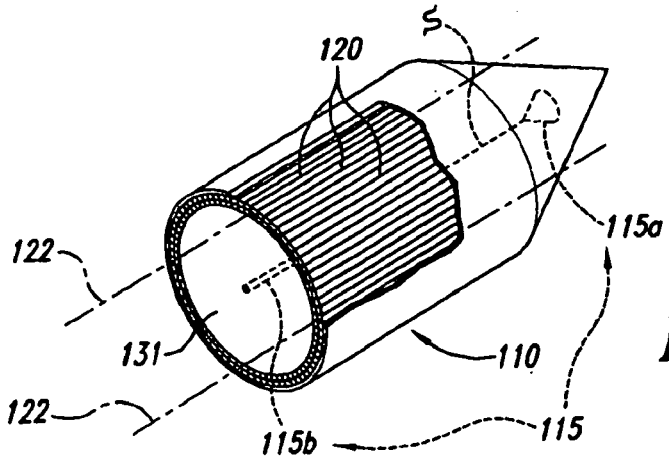
FIG. 2B is an enlarged, isometric cross-sectional view of the projectile shown in FIG. 2A taken substantially along line 2B-2B.

FIG. 2A is an enlarged, isometric illustration of a portion of the projectile 110 of FIG. 1A shown with a portion removed to expose the arrangement of rods 120 carried in the first position by the projectile 110. FIG. 2B is an enlarged, isometric cross-sectional view of the projectile 110 taken substantially along lines 2B-2B of FIG. 2A further illustrating the arrangement of rods 120 in the first position. As shown in FIG. 2B, each rod 120 has a longitudinal axis 122. In the first position, the rods 120 are arranged to form two concentric layers of rods around the explosive charge 131 so the longitudinal axes 122 of the rods 120 forming a layer are generally parallel. The rods 120 of the concentric layers are coupled together at alternating ends, for example, by pinning or spot welding. Other embodiments can have different arrangements, for example, a single layer of interconnected rods 120.

The projectile 110 of the illustrated embodiment has a trigger system 115 that includes at least one sensor 115*a* that determines when the projectile has reached the selected position 170 (FIG. 1B). The selected position can be based on a distance or time of flight from the impact area, or a distance or time of flight from the launch point, for example, when the launch point is a specified distance from the impact area. The sensor 115*a* can include various types of sensors, including timers and/or proximity sensors (e.g., radar, acoustical, and/or laser sensors). In at least one embodiment, the projectile 110 can be launched from or near the selected position 170 (FIG. 1B) and the rods 120 can be configured to begin expanding toward the second position just after the projectile 110 is launched, negating the need for a sensor. The trigger system 115 can include at least one booster 115*b*, such as an accelerant or the like, for detonating the explosive charge 131. When the sensor 115*a* determines that the projectile 110 is at the selected position, it sends a signal via a signal pathway, shown as S in FIG. 2B, to the booster 115*b*. The booster 115*b* is activated and detonates the explosive charge 131, thereby creating a deploying force that causes the arrangement of rods 120 to radially expand from the first position to the second position, as discussed above with reference to FIGS. 1A-B.

Figure 2C:
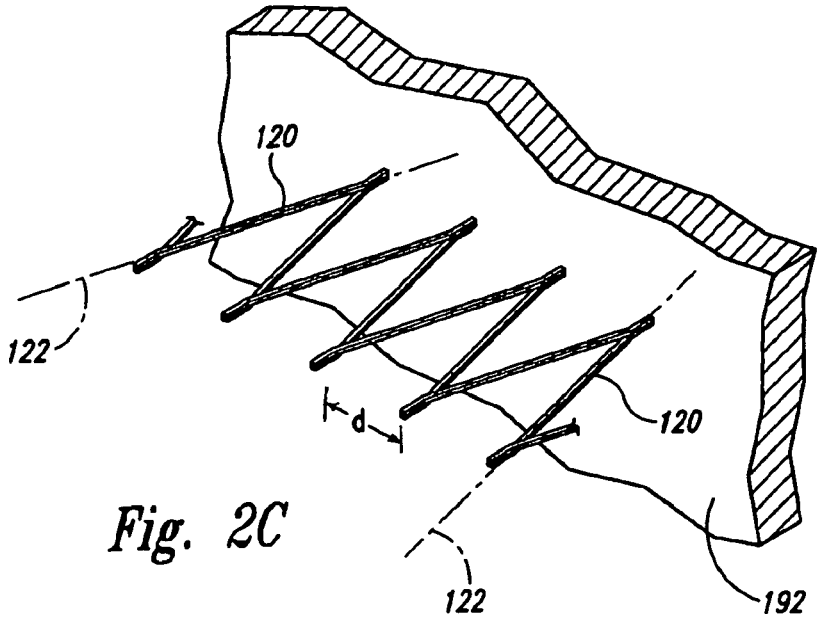
FIG. 2C is an enlarged, partially schematic illustration of a portion of the arrangement of rods of FIG. 2B in a partially expanded position.
Figure 2D:
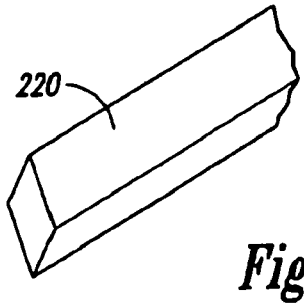
FIG. 2D is an enlarged, partially schematic illustration of a portion of a rod used to form the arrangement of rods in FIG. 2A in accordance with a further embodiment of the invention.

FIG. 2C shows a portion of the arrangement of rods 120 in the second position, impacting a portion of the impact area 192, as described with reference to FIGS. 1B-C. Because the rods 120 are coupled together at alternating ends, as the arrangement of rods 120 expands, the rods 120 pivot relative to each other so that the longitudinal axes 122 of adjacent rods 120 are no longer parallel. Accordingly, the rods 120 hit the impact area 192 with the longitudinal axes 122 of the rods 120 non-parallel to the trajectory 180 (FIG. 1B). In FIG. 2C, the rod ends are attached by a weld and the rod ends are configured to bend as the arrangement of rods expands toward the second position. In other embodiments, at least some of the rods 120 can become unattached as the arrangement of rods 120 radially expands.

The orientation of the rods 120 at impact can be controlled by several factors, including the configuration of the arrangement of rods 120 (e.g., rod length and method of attachment) when in the first position, the velocity of the projectile, the expansion rate of the arrangement of rods 120, and the selected position where the rods 120 begin to expand. For example, in one embodiment, a 105 mm M393A2-sized projectile can be fired using an Armtec Combustible Cartridge Case (available form Armtec of Coachella, Calif.) at a muzzle velocity of 1,400 meters per second. The projectile can carry an arrangement of 88 rods 120 that includes two concentric layers of 44 eight-inch-long metal rods 120, attached at alternating ends, as shown in FIG. 2B. Each rod 120 can have a quarter inch by quarter inch square cross section. Other embodiments can have other shapes and sizes.

In the present embodiment, the arrangement of rods in the first position can have an inner diameter of three and a half inches and can surrounds the explosive charge. The explosive charge can be sized to create a force upon detonation that will radially expand the arrangement of rods at approximately 1,000 feet per second. The explosive charge can be connected to a detonating assembly configured to activate the explosive charge at a selected time and/or location. In one embodiment, the detonating assembly is an M830A1 type proximity fuze mounted to the nose of the projectile and set to fire the explosive charge at approximately eight and one quarter feet from the impact area. By the time the arrangement of rods 120 travels the eight and one-quarter feet, the rods will impact the impact area 192 in an approximately four foot diameter loop-type formation with the rods 120 still generally connected. The rods 120 will impact the impact area 192 with their elongated axes 122 non-parallel, but predominantly end first with the trailing end displaced approximately 1.9 inches laterally from the leading end, shown as distance d in FIG. 2C. This arrangement can be particularly effective in penetrating and/or cutting through high-strength structures, such as concrete structures reinforced with re-bar.

Other embodiments can use different parameters and/or different arrangements. For example, in other embodiments, the rods forming the arrangement of rods can have other shapes, e.g., the rods can be round or diamond-shaped, similar to a portion of a rod 220 shown in FIG. 2D. In still other embodiments, the arrangement of rods can include rods that are not interconnected at alternating ends. Accordingly, the rods can be expanded in a manner so that the elongated axis of each rod is approximately parallel to the trajectory of the projectile when the rods impact the ground-supported structure. In other embodiments, the unattached rods can be expanded in a manner so that they impact the ground-supported structure with their elongated axes non-parallel to the trajectory, for example, an uneven force can expand the arrangement of rods (e.g., a shaped charge can be used to expand the rods). In still other embodiments, the projectile can be launched without a launcher or from an airborne position (e.g., self-launched like certain unmanned aerial vehicles, launched from an aircraft, or dropped from an aircraft).

A feature of foregoing embodiments of rod warhead systems described above is that a single projectile can be used to breach a ground-supported structure (including the re-bar or other reinforcements within a structure) creating an aperture that allows troop passage. An advantage of this feature is that the aperture can be created more quickly than using the present method of firing multiple rounds, thereby providing a greater element of surprise. An additional advantage is that when troops are under fire, an aperture can be formed more quickly than using current methods, reducing the time that troops are exposed to hostile fire.

Figure 3:
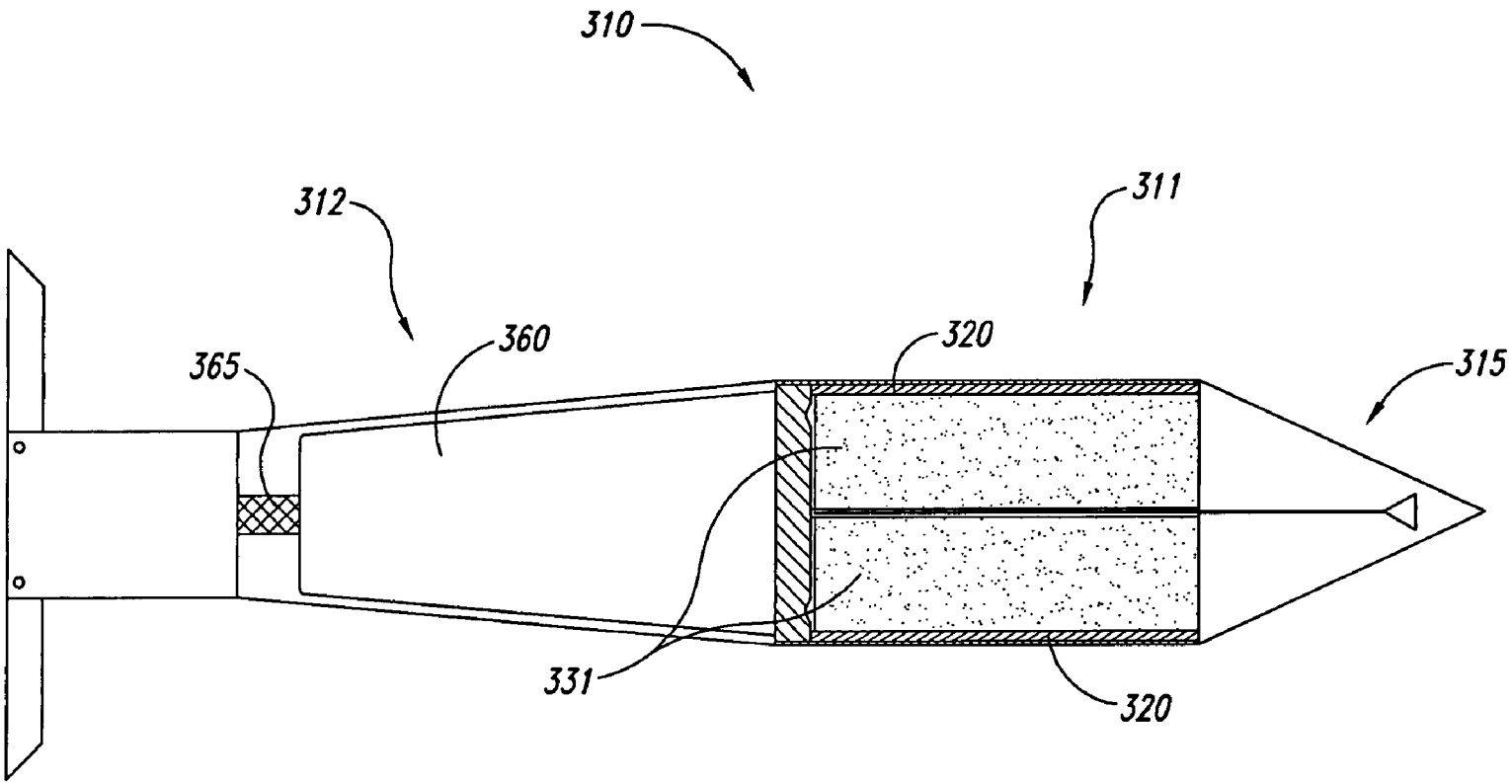
FIG. 3 is a partially schematic cross-sectional illustration of the projectile having an arrangement of rods and a follow-up explosive charge.

FIG. 3 is a partially schematic cross-sectional illustration of a warhead projectile 310, similar to the projectile 110 shown in FIGS. 2A-B except the warhead projectile 310 includes a follow-up explosive charge that aids in the removal of material from the impact area after the arrangement of rods has impacted the ground-supported structure or other object. The warhead projectile 310 of the illustrated embodiment includes a forward portion 311 and aft portion 312. The forward portion 311 includes a firing device 315 and an arrangement of rods 320 surrounding a deployment mechanism, such as an explosive charge 331. The aft portion 312 of the warhead projectile 310 includes a follow-up explosive charge 360 and a follow-up firing device 365 configured to detonate the follow-up explosive charge.

Figure 4A:
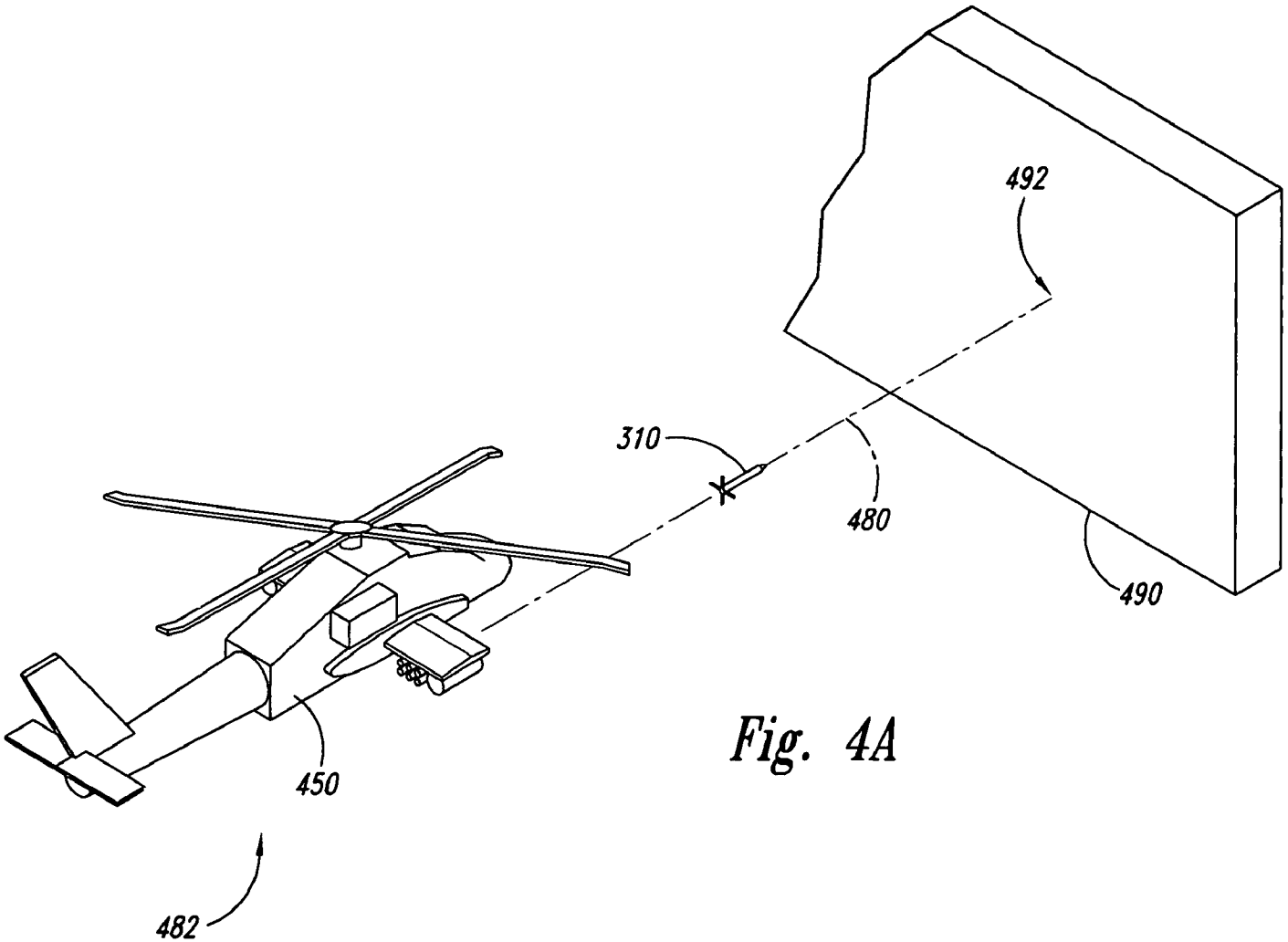
FIG. 4A is a partially schematic illustration of a rod warhead system, with a follow-up explosive charge, used to breach an object in accordance with another embodiment of the invention.
Figure 4B:
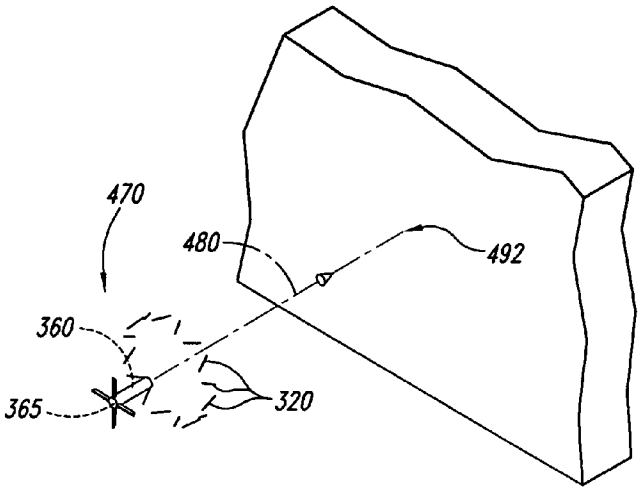
FIG. 4B is a partially schematic illustration of the rod warhead system shown in FIG. 4A, prior to the arrangement of rods impacting the object.
Figure 4D:
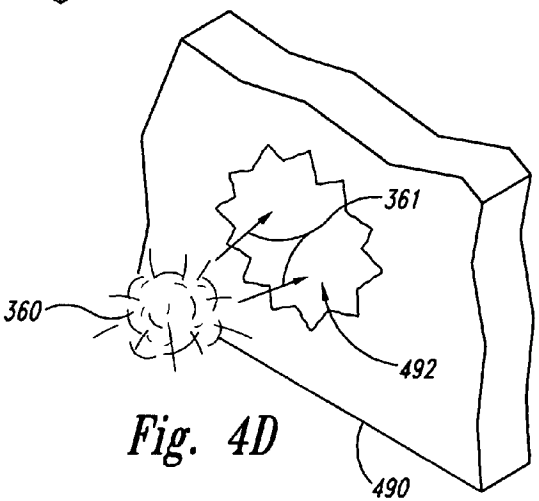
FIG. 4D is a partially schematic illustration of the rod warhead system of FIG. 4A with an explosive force being exerted proximate to the object, in accordance with a further embodiment of the invention.

The following is one example of a use and operation of the projectile 310. As shown in FIG. 4A, a launcher 450 in an airborne position 482 (e.g., an airborne helicopter) launches the projectile 310 along a trajectory 480 toward an impact area 492 of an object 490 (e.g., wall, building, ground vehicle, water vessel, or aircraft). In other embodiments, the projectile 310 can be launched from a ground-based position. As shown in FIG. 4B, upon passing a selected position 470 relative to the impact area 492, the arrangement of rods 320 are deployed and expanded radially about the trajectory 480 of the projectile to a second position as the rods 320 in the loop formation move toward the impact area 492. The follow-up explosive charge 360 and the follow-up firing device 365 also continue toward the impact area 492.

Figure 4C:
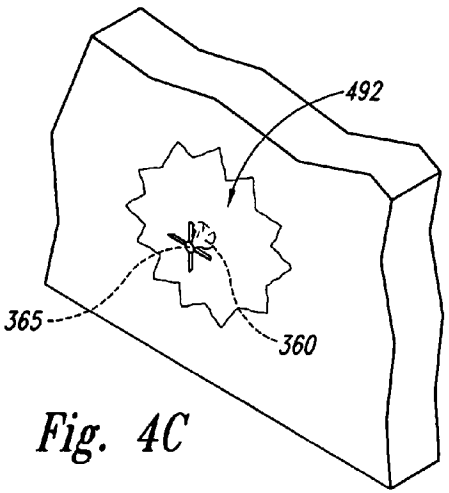
FIG. 4C is a partially schematic illustration of the rod warhead system shown in FIG. 4A, after the arrangement of rods has impacted the object, but before an explosive force has been exerted proximate to the object.

The arrangement of rods 320 in the loop formation hits the impact area 492 and penetrates and/or cuts through a portion of the impact area 492 in a cookie-cutter fashion. The arrangement of rods 320 does not remove all of the material within the cut portion of the impact area 492. In one embodiment, the follow-up explosive charge 360 is a high explosive plastic charge that continues along the trajectory 480 and impacts the impact area 492 at the same time or slightly after the arrangement of rods 320 is cutting through the impact area 492. The impact causes the follow-up explosive charge 360 to deform and spread out over a portion of the impact area 492, as shown in FIG. 4C. The follow-up firing device 365 impacts the impact area 492 after the follow-up explosive charge 360, and causes the follow-up charge to detonate. The explosive force created by the follow-up explosive charge 360 removes additional material from the impact area 492, which has already been cut by the arrangement of rods 320, thereby creating an enlarged aperture in the impact area 492.

In another embodiment, the follow-up explosive charge can be self-detonating on impact, negating the need for a follow-up firing device. In still other embodiments, the follow-up explosive charge can be detonated prior to impacting the object. For example, in FIG. 4D the follow-up explosive charge 360 has been detonated proximate to the object 490 and the impact area 492 so that an explosive force 361 is applied to the object 490 just after the arrangement of rods 320 has cut through the impact area 492. This feature can be particularly useful when the aft portion 312 of the projectile 310, carrying the follow-up explosive charge 360, takes on a high drag profile after the arrangement of rods 320 begins to expand. The follow-up explosive charge 360 can be detonated based on various sensors (e.g., timers, proximity fuzes, or mechanical linkages) which are the same as, coupled to, and/or separate from other sensors/trigger devices carried by the projectile. In yet other embodiments, the follow-up explosive charge can be a separate projectile or charge that applies an explosive force after the impact of the arrangement of rods.

One feature of the rod warhead systems described above with reference to FIGS. 3-4D is that the follow-up charge 360 can provide additional force to remove material from the impact area 492 after the arrangement of rods 320 has penetrated the impact area. An advantage of this feature is that a breach in the impact area can be quickly formed, even when the impact area is made from robust or reinforced materials, thereby allowing waiting troops and equipment to pass through the breach with little or no delay being required to remove debris. Another advantage of the feature is that debris will be explosively removed from the impact area and can be explosively scattered like shrapnel throughout a volume of space behind the impact area, for example, throughout the interior of a structure, further clearing the area behind the structure for troop ingress.

Rod warhead systems can use various force generating mechanisms, singularly or in combination, to expand the arrangement of rods toward the second position with desired expansion characteristics. For example, a rod warhead system can use an explosive charge, as discussed above with reference to FIGS. 1A-4, sized or tailored to provide a selected expansion rate of the arrangement of rods. Other force generating mechanisms can be similarly tailored to provide selected expansion characteristics. Various force generating mechanisms that do not include a dedicated explosive charge are discussed in detail below.

Figure 5A:
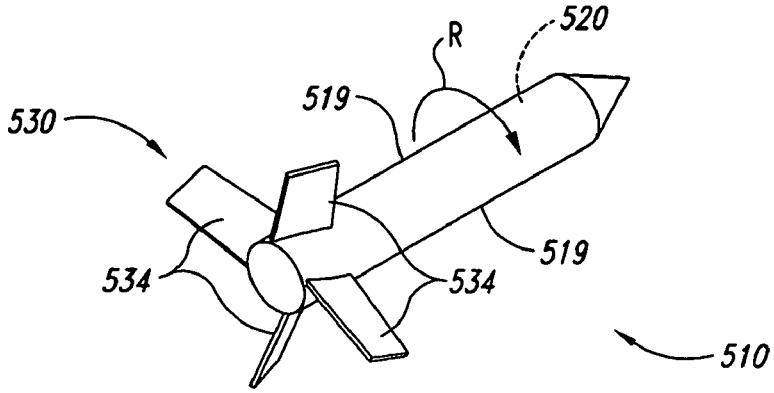
FIG. 5A is a partially schematic illustration of a projectile with a rotation device in accordance with another embodiment of the invention.

FIG. 5A is a partially schematic illustration of a projectile 510 that includes a force generating mechanism 530 configured to generate a centrifugal force to expand the arrangement of rods 520. The force generating mechanism 530 of the illustrated embodiment includes four rotation devices 534. Other embodiments can have more or fewer rotation devices 534 and/or different rotation device(s) (e.g., rotation jets).

Figure 5B:
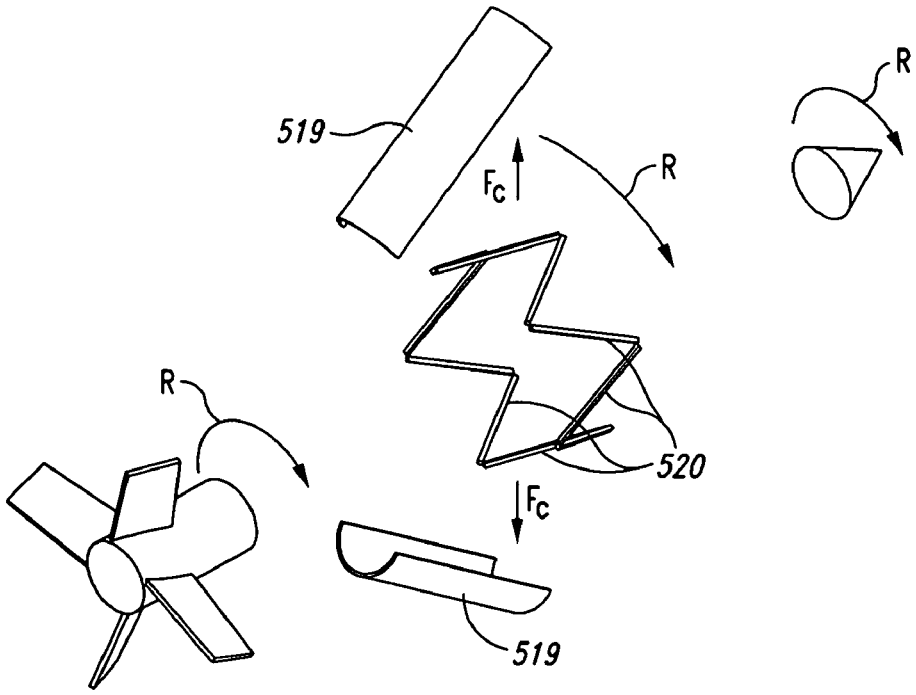
FIG. 5B is a partially schematic illustration of the projectile of FIG. 5A with the rods expanding toward a second position.

As the projectile 510 travels towards the impact area, the rotation devices 534 aerodynamically interact with the environment, causing the projectile to rotate in the direction of arrow R. The arrangement of rods 520 is held in a first position by casing 519. As the projectile 510 travels toward an impact area, the casing 519 is released, releasing the arrangement of rods 520. As shown in FIG. 5B, the rotation R creates a centrifugal force depicted by arrows $F_c$ causing the arrangement of rods 520 to radially expand from the first position to the second position. Additionally, when the arrangement of rods 520 impacts the impact area, the rotation of the rods 520 can aid the rods in penetrating and/or cutting through the impact area. In other embodiments, other configurations can be used to restrain the arrangement of rods 520 in the first position, for example, straps can be used to restrain the arrangement of rods 520. In still other embodiments, the projectile is not rotated, but the arrangement of rods is given a rotational velocity upon release, for example, by the use of an internal motor that spins the rods relative to a fin stabilized projectile.

Figure 6A:
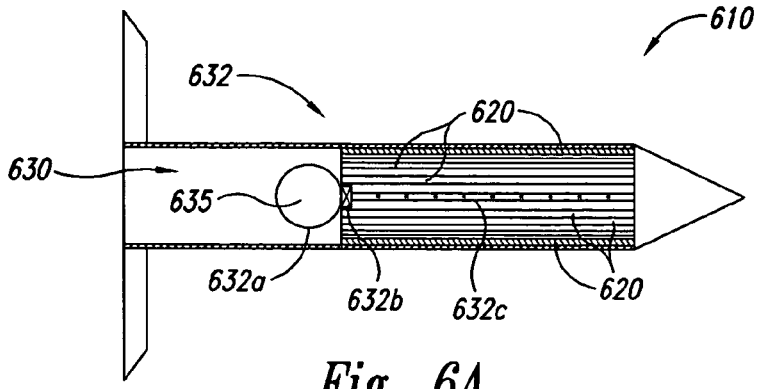
FIG. 6A is a partially schematic cross-sectional illustration of a projectile that uses the release of a stored fluid to expand the arrangement of rods in accordance with another embodiment of the invention.
Figure 6B:
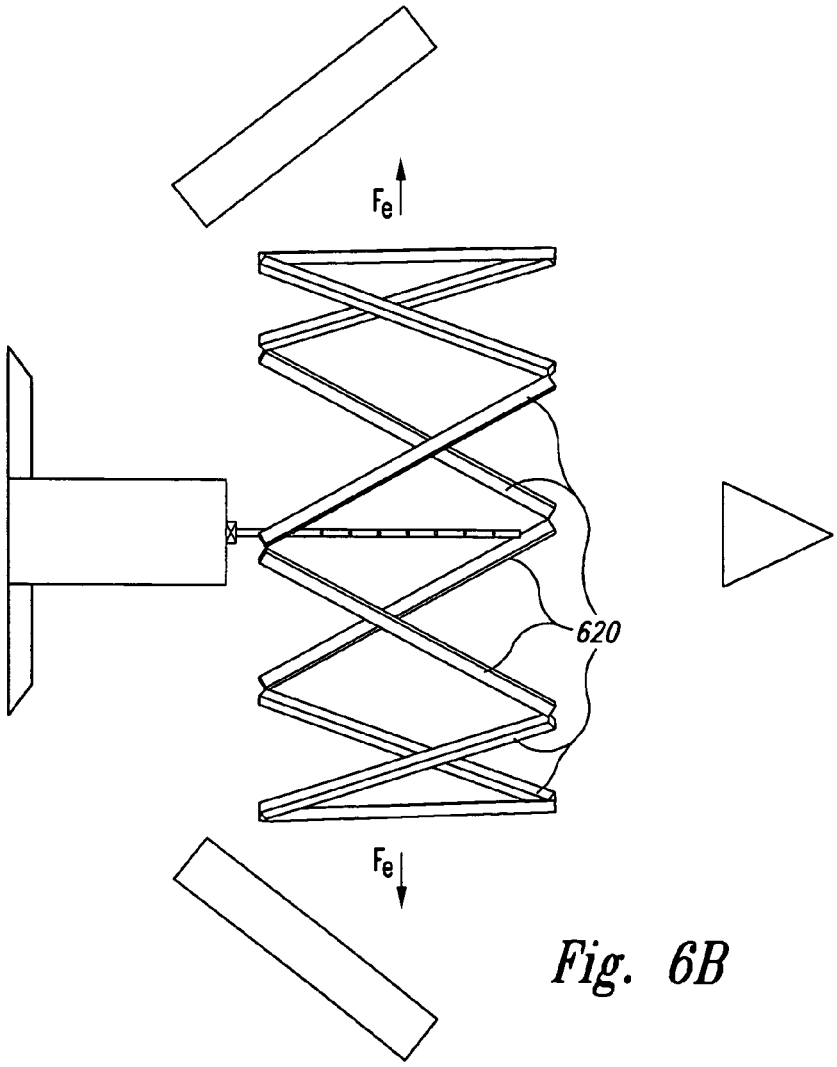
FIG. 6B is a partially schematic illustration of the projectile, shown in FIG. 6A with the rods expanding toward a second position.

FIG. 6A is a partially schematic cross-sectional illustration of a projectile 610 that includes a force generating mechanism 630 to radially expand the arrangement of rods 620. The force generating mechanism 630 is configured to use a release of a fluid 635 proximate to the arrangement of rods 620 to generate at least one force to radially expand the rods 620. In one embodiment, the force generating mechanism 630 includes at least one passageway 632 having a vessel 632*a* that stores a fluid 635 (e.g., a liquid or a gas) under pressure. The force generating mechanism 630 includes a valve 632*b* and a release manifold 632*c* coupled to the vessel 632*a*. As the projectile 610 travels towards the impact area and reaches a selected position, the valve 632*b* is opened, thereby allowing the fluid 635 to pass through the release manifold 632*c* and to apply a significant force $F_e$ to radially expand the arrangement of rods 620, as shown in FIG. 6B.

Figure 7A:
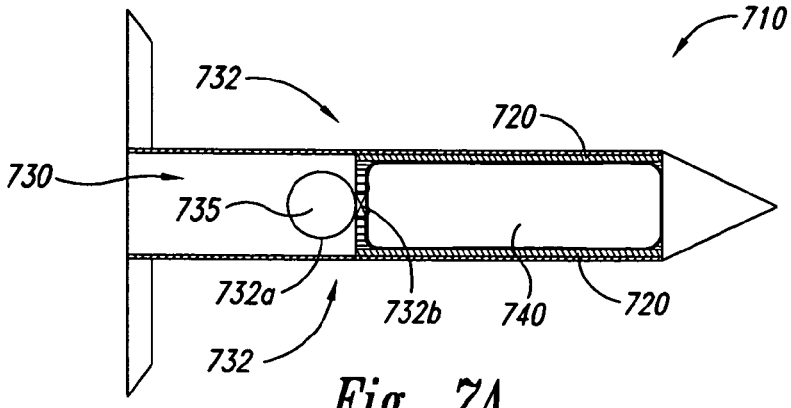
FIG. 7A is a partially schematic cross-sectional illustration of a projectile that uses a stored fluid to expand the arrangements of rods in accordance with a further embodiment of the invention.

FIG. 7A is a partially schematic cross-sectional illustration of a projectile 710 that includes a force generating mechanism 730 configured to use a release of a fluid 735 proximate to a membrane 740 to generate at least one force to expand the arrangement of rods 720. The membrane 740 is located proximate to the arrangement of rods 720 and can include a flexible material (e.g., a bag or a sheet) that can be folded or placed in a contracted position. The membrane 740 is configured to rapidly move from the contracted position to an expanded position in response to a force (e.g., created by a release of a fluid).

Figure 7B:
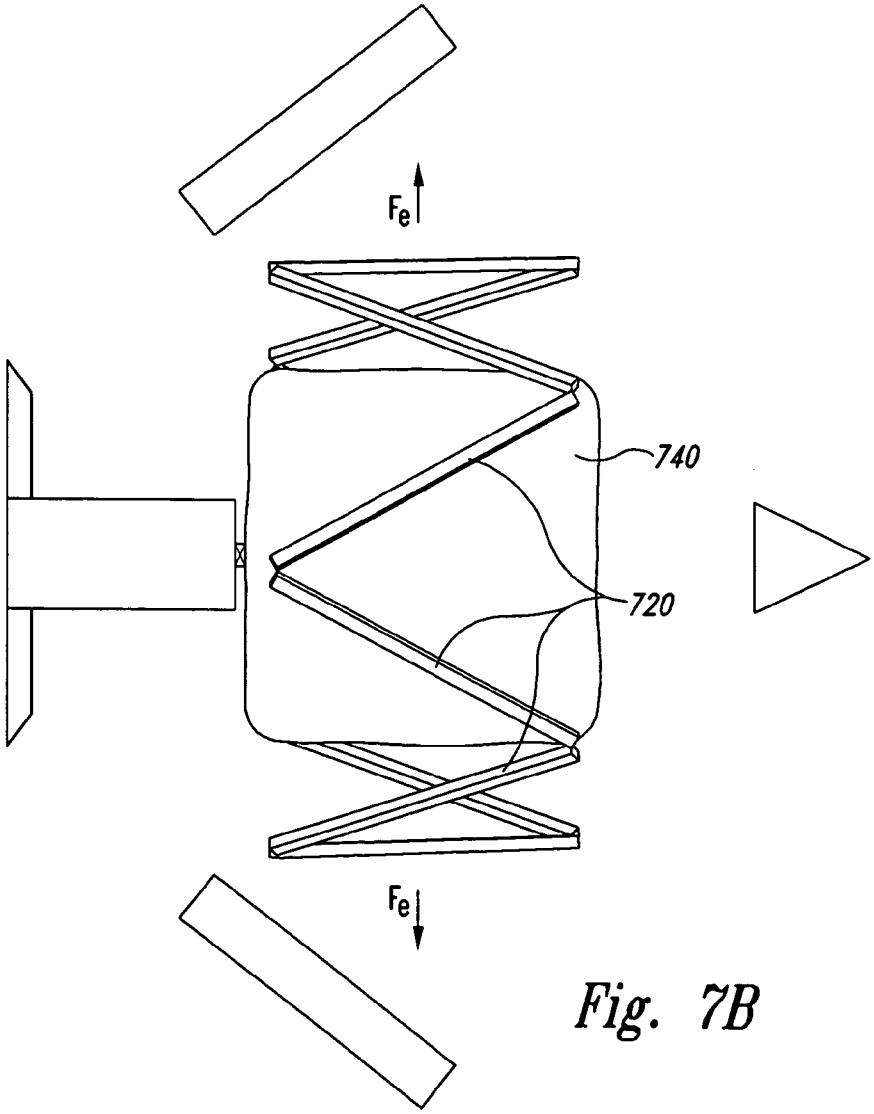
FIG. 7B is a partially schematic view of the projectile, shown in FIG. 7A with the rods expanding toward a second position.

The force generating mechanism 730 includes at least one passageway 732 for releasing a fluid 735 proximate to the membrane 740. The at least one passageway 732 includes a valve 732*b* and a vessel 732*a* that stores the fluid 735 under pressure. As the projectile 710 travels towards the impact area, the valve 732*b* is opened at a selected position, allowing the fluid 735 to be rapidly released proximate to the membrane 740. The release of the stored fluids 735 creates a force $F_e$ that moves the membrane 740 from the contracted position to the expanded position and correspondingly causes the arrangement of rods 720 to quickly expand, as shown in FIG. 7B, toward the second position.

Figure 8A:
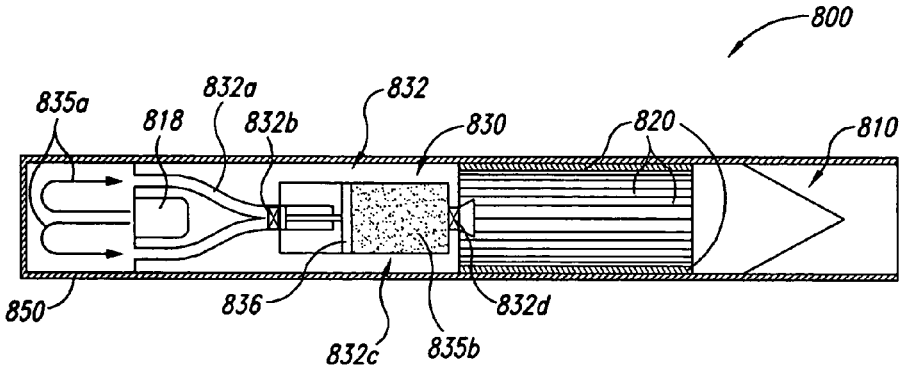
FIG. 8A is a partially schematic illustration of a rod warhead system that uses a portion of the expanding fluid used to propel the projectile to charge an accumulator, which releases a fluid to expand the arrangement of rods in accordance with still another embodiment of the invention.

FIG. 8A is a partially schematic illustration of a rod warhead system 800 having a launcher 850 and a projectile 810 that includes a force generating mechanism 830 configured to use a portion of an expanding fluid 835*a*, which also is used to propel the projectile, to generate at least one force to radially expand an arrangement of rods 820. The projectile 810 includes a propellant 818 (e.g., a stored gas or a combustible material with a primer) and is configured to be propelled toward an impact area by the release of the expanding fluid 835*a* created by the propellant 818. The projectile 810 also includes an arrangement of rods 820 and a force generating mechanism 830 having at least one passageway 832. The passageway 832 includes a collection manifold 832*a*, a one-way valve 832*b*, an accumulator 832*c*, and a valve 832*d*.

Figure 8B:
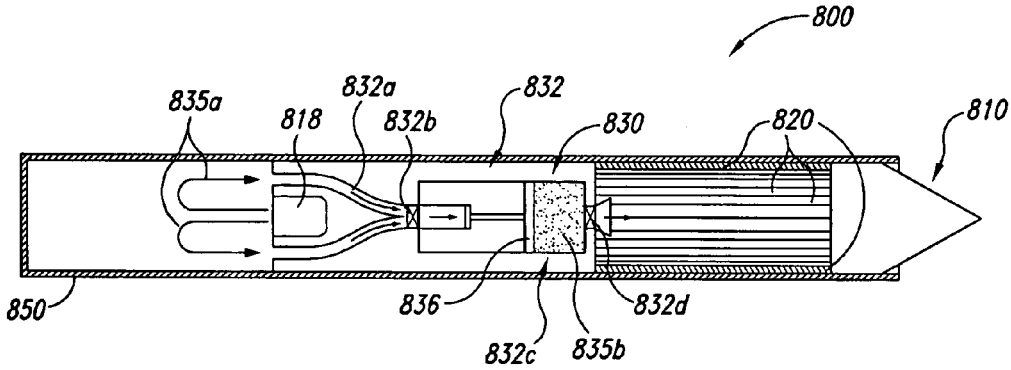
FIG. 8B is a partially schematic illustration of the charged accumulator of the rod warhead system shown in FIG. 8A.

A portion of the expanding fluid 835*a* used to propel the projectile toward the impact area passes through the collection manifold 832*a*, through the one-way valve 832*b*, and to the accumulator 832*c*. The expanding fluid 835*a* moves a plunger 836, causing the accumulator 832*c* to compress a second fluid 835*b*, as shown in FIG. 8B. As the projectile 810, shown in FIG. 8A, travels towards the impact area, the valve 832*d* is opened at a selected position, allowing the second fluid 835*b* to be released proximate to the arrangement of rods 820, causing the rods to expand.

In other embodiments, the second fluid 835*b* can be released proximate to a membrane that is located proximate to the rods, causing the membrane to move from a contracted position to an expanded position and to expand the arrangement of rods 820, in a manner similar to that discussed above with reference to FIG. 7A. In yet other embodiments, the at least one passageway 832 can also include a release manifold for releasing the second fluid 835*b* proximate to the arrangement of rods 820, as discussed above with reference to FIG. 6A. In still other embodiments, the accumulator 832*c* is charged by collecting and storing the expanding fluid 835*a* under pressure (instead of using the expanding fluid 835*a* to compress a second fluid 835*b*), later releasing the stored expanding fluid 835*a* in place of releasing a second fluid 835*b*. In further embodiments, the expanding fluid 835*a* that propels the projectile toward the impact area can be created by the launcher 850 and/or provided to the launcher 850 from an external source (e.g., stored compressed air). In still further embodiments, the expanding fluid 835*a* can be created by an explosive element that is placed in the launcher 850 along with the projectile.

Figure 9:
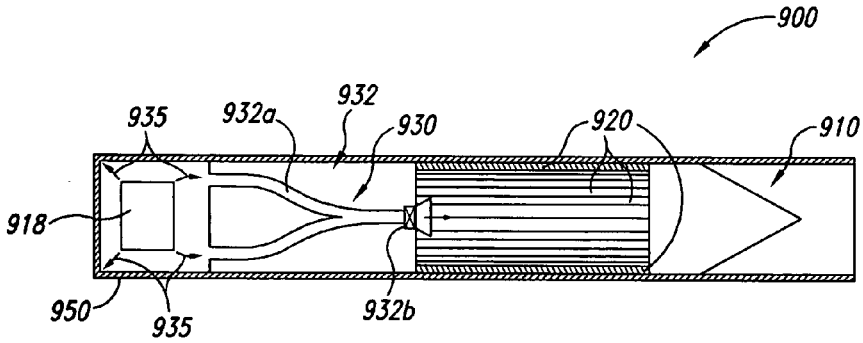
FIG. 9 is a partially schematic illustration of a rod warhead system that uses the expanding fluid that propels the projectile to expand the arrangement of rods in accordance with a further embodiment of the invention.

FIG. 9 is a partially schematic illustration of a rod warhead system 900 of another embodiment. The rod warhead system 900 has a launcher 950 and a projectile 910 that includes a force generating mechanism 930. The force generating mechanism 930 is configured to use a portion of an expanding fluid 935, which is also used to propel the projectile, to generate at least one force to radially expand an arrangement of rods 920. The projectile 910 is propelled toward the impact area by an expanding fluid 935 created by an explosive element or propellant 918 placed in the launcher with the projectile. The projectile 910 includes an arrangement of rods 920 and a force generating mechanism 930 having at least one passageway 932. In FIG. 9, the at least one passageway includes a collection manifold 932*a* and a one-way valve 932*b*.

When the propellant 918 is ignited, it releases an expanding fluid 935 inside the launcher 950 propelling the projectile 910 out of the launcher and along a trajectory to the impact area. A portion of the expanding fluid 935 passes through the collection manifold 932*a*, through the one-way valve 932*b*, and is released proximate to the arrangement of rods 920, causing the arrangement of rods 920 to expand from a first to a second position, as discussed above with reference to FIGS. 1A-2B. Because the rods 920 begin to expand almost immediately after the launch process is initiated (e.g., the rods 920 begin to expand immediately upon leaving the launcher 950), the launcher 950 is generally located at or near a selected position so that the rods 920 will reach the second position prior to impacting an impact area. In other embodiments, the at least one passageway 932 can include a release manifold for releasing the fluid 935 proximate to the arrangement of rods 920, as discussed above with reference to FIG. 6A. In still other embodiments, the fluid 935 can be released proximate to a membrane that is located proximate to the rods 920, causing the membrane to move from a contracted position to an expanded position and to expand the arrangement of rods 920, as discussed with reference to FIG. 7A.

Figure 10A:
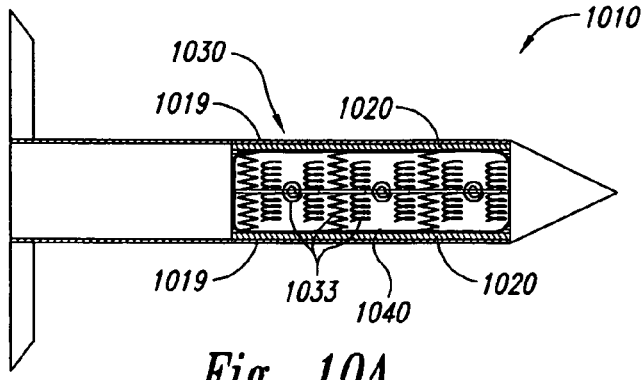
FIG. 10A is a partially schematic cross-sectional illustration of a projectile having a spring device configured to expand the arrangement of rods in accordance with yet another embodiment of the invention.
Figure 10B:
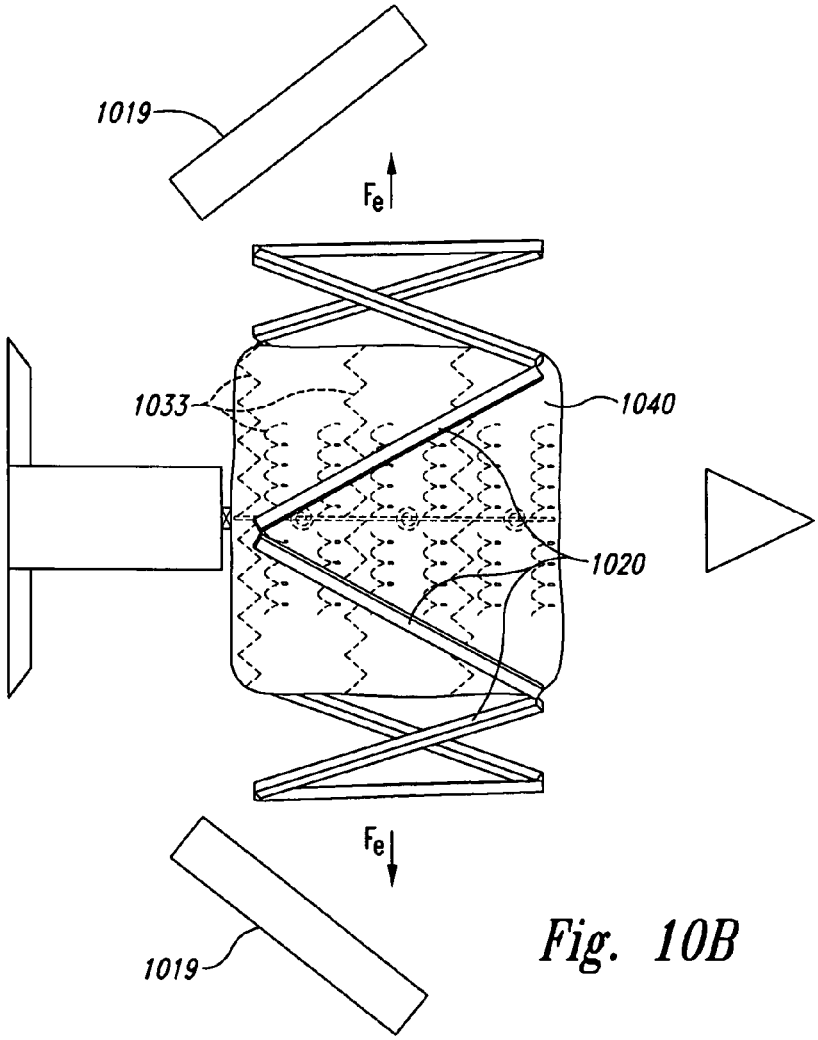
FIG. 10B is a partially schematic illustration of the projectile, shown in FIG. 10A with the rods expanding toward a second position.

FIG. 10A is a partially schematic cross-sectional illustration of a projectile 1010 that includes a force generating mechanism 1030, having one or more spring device(s) 1033 configured to generate at least one force to quickly expand the arrangement of rods 1020 radially. In FIG. 10A, multiple spring devices 1033 are shown in a compressed state inside a membrane 1040. The membrane 1040 is located proximate to the arrangement of rods 1020. The arrangement of rods 1020 are held in the first position by at least one casing 1019 (two casings 1019 are shown in FIG. 10A) and, in turn, the arrangement of rods 1020 hold the spring devices 1033 in the compressed state. As the projectile 1010 travels towards an impact area, the casing(s) 1019 is/are released at a selected position, allowing the force $F_e$ created by the spring devices 1033 to move the membrane 1040 from a contracted position to an expanded position and to expand the arrangement of rods 1020, as shown in FIG. 10B.

Other embodiments can have more or fewer and/or different types of spring devices 1033. For example, a single coiled spring device having a compressed state, where the coils have a first diameter, and an expanded state, where the coils have a second larger diameter, can be used to expand the arrangement of rods 1020. In still other embodiments, other arrangements can be used to restrain the arrangement of rods 1020 and/or the spring device(s) 1033, for example, straps can be used to restrain the arrangement of rods 1020. In yet other embodiments, the spring device can be used without a membrane 1040.

A feature of embodiments of rod warhead systems described above is that an arrangement of rods can be expanded without using a separate dedicated explosive charge. An advantage of this feature is that the arrangement of rods can be expanded from the first position to the second position in an even and smooth manner providing a more precise position of the arrangement of the rods at impact. Another advantage of this feature is that less or in some cases no explosive material is required to be included in the projectile, reducing the need for special handling and/or special safety procedures.

From the foregoing, it will be appreciated that specific embodiments of the invention have been described herein for purposes of illustration, but that various modifications may be made without deviating from the spirit and scope of the invention. Systems and methods in accordance with further embodiments of the invention can include other combinations of the features described above. For example, several of the rod expansion techniques described above can be combined and/or a membrane can be used in combination with any of the expansion techniques, including the use of a dedicated explosive charge or a centrifugal force. Accordingly, the invention is not limited except by the following claims.

I claim:

1. A breaching method for creating a passageway through which personnel can pass, comprising:

propelling a projectile along a trajectory toward a generally planar ground-supported structure, the projectile carrying an arrangement of rods expandable from a first position to a second position forming a substantially continuous loop formation;

expanding the arrangement of rods radially relative to the trajectory from the first position to the second position prior to the projectile impacting the generally planar ground-supported structure;

impacting the arrangement of rods in the second position against an impact area of the generally planar ground-supported structure wherein the impact area in an unbreached condition is constructed in a manner that would prevent the personnel from passing therethrough;

breaching the impact area of the generally planar ground-supported structure with the arrangement of rods in the second position; and creating an aperture in the impact area of the generally planar ground-supported structure of a shape and size that allows personnel to pass through the aperture in the impact area.

2. The method of claim 1 wherein creating the aperture includes creating the aperture at least approximately the size of the arrangement of rods in the second position.

3. The method of claim 1, further comprising applying an explosive force to the generally planar ground-supported structure proximate to the impact area after the arrangement of rods impacts the impact area of the generally planar ground-supported structure.

4. The method of claim 1, further comprising:

applying an explosive force to the generally planar ground-supported structure proximate to the impact area after the arrangement of rods impacts the impact area of the generally planar ground-supported structure; and removing at least a portion of material from the impact area of the generally planar ground-supported structure with the explosive force to create the aperture.

5. The method of claim 1 wherein expanding the arrangement of rods includes expanding the arrangement of rods at least approximately at a selected position away from the impact area.

6. The method of claim 1 wherein breaching the impact area of the generally planar ground-supported structure includes cutting through the impact area with the arrangement of rods in a direction substantially parallel to the trajectory of the projectile.

7. The method of claim 1 wherein expanding the arrangement of rods includes expanding the arrangement of rods from the first position, wherein the rods are interconnected at alternating ends and the longitudinal axes of the rods are at least approximately parallel to each other, to the second position wherein the rods are rotated so that the longitudinal axes of the rods are not parallel to each other.

8. The method of claim 1 wherein expanding the arrangement of rods includes expanding the arrangement of rods from the first position, wherein the rods are attached at alternating ends and the longitudinal axes of the rods are at least approximately parallel to each other to a second position wherein the rods are rotated so that the longitudinal axes of the rods are not parallel to each other and at least some of the rods are not connected.

9. The method of claim 1 wherein expanding the arrangement of rods includes rotating the arrangement of rods at least approximately about the trajectory of the projectile.

10. The method of claim 1 wherein expanding the arrangement of rods includes applying a radially directed force to the arrangement of rods when in the first position generated by at least one of an explosive charge.

11. The method of claim 1 wherein expanding the arrangement of rods includes applying a force to a membrane and moving the membrane from a contracted position to an expanded position to expand the arrangement of rods.

12. The method of claim 1 wherein propelling a projectile along a trajectory includes propelling the projectile from a ground-based position.

13. The method of claim 1 wherein propelling a projectile along a trajectory includes propelling the projectile from an airborne position.

* * * * *